US008789465B2

(12) United States Patent
Novak et al.

(10) Patent No.: US 8,789,465 B2
(45) Date of Patent: Jul. 29, 2014

(54) PRINTING PRESS COLOR REPLACEMENT AND CLEANING SYSTEM

(75) Inventors: Ronen Novak, Tel Aviv (IL); Oren Wilde, Rishon Le Zion (IL); Vadim Genkin, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1682 days.

(21) Appl. No.: 12/297,723

(22) PCT Filed: Apr. 19, 2006

(86) PCT No.: PCT/US2006/014783

§ 371 (c)(1),
(2), (4) Date: Mar. 17, 2009

(87) PCT Pub. No.: WO2007/120150

PCT Pub. Date: Oct. 25, 2007

(65) Prior Publication Data

US 2013/0000504 A1 Jan. 3, 2013

(51) Int. Cl.
*B41F 35/00* (2006.01)

(52) U.S. Cl.
CPC ..... *B41F 35/00* (2013.01)
USPC ..... 101/425; 101/423

(58) Field of Classification Search
CPC ..... B41F 35/00
USPC ..... 101/425
See application file for complete search history.

(56) References Cited

U.S. PATENT DOCUMENTS

| | | | | |
|---|---|---|---|---|
| 5,813,344 | A * | 9/1998 | Maruyama et al. | 101/424 |
| 5,915,302 | A * | 6/1999 | Baba et al. | 101/366 |
| 6,293,198 | B1 * | 9/2001 | Mizuno | 101/483 |
| 6,367,905 | B1 * | 4/2002 | Sharma et al. | 347/33 |
| 7,165,494 | B2 * | 1/2007 | Shields | 101/483 |
| 7,195,333 | B2 * | 3/2007 | Huliba | 347/28 |
| 7,641,448 | B2 * | 1/2010 | Gydesen | 417/4 |
| 2002/0023561 | A1 * | 2/2002 | Leimand | 101/366 |
| 2004/0036735 | A1 * | 2/2004 | Garbacz et al. | 347/22 |
| 2004/0135859 | A1 * | 7/2004 | German et al. | 347/95 |

FOREIGN PATENT DOCUMENTS

| | | | |
|---|---|---|---|
| AT | 407134 | B | 12/2000 |
| DE | 4338625 | A1 | 5/1995 |
| DE | 4424581 | C1 | 10/1995 |
| DE | 29601643 | U1 | 5/1997 |
| JP | 08-336955 | A | 12/1996 |
| WO | 98/42511 | A | 10/1998 |

OTHER PUBLICATIONS

International Search Report for Patent Application PCT/US2006/014783: May 9, 2007.

* cited by examiner

*Primary Examiner* — Anthony Nguyen

(57) ABSTRACT

A method, at least partially implemented by means of processor-executable instructions, for exchanging colors within a color station of a printing press is disclosed. In one implementation of the method, a cleaning tank is operated within the color station, thereby cleaning the color station. Additionally, a new color of ink is built within the cleaned color station.

10 Claims, 4 Drawing Sheets

PRINTING PRESS COLOR REPLACEMENT AND CLEANING SYSTEM

BACKGROUND OF THE INVENTION

The inks and/or ink colors required for all print jobs are not the same. For example, many print jobs can benefit from the addition of one or more 'specialty ink colors,' (e.g. spot colors) which improves the print job's appearance, but which may have little utility in other, print jobs. Thus, there is a value in configuring a printer and/or printing press to utilize specialty colors for some printing jobs. This value can be realized by removing an unneeded color and installing the needed color. Unfortunately, there is also a cost associated with making this reconfiguration.

Part of the cost of configuring a printer or printing press to use one or more specialty colors includes costs associated with temporary suspension of printing operations to allow for reconfiguration of a color station with a new ink color. While the printer or press is stopped, ink supply structures associated with one or more of the currently installed ink colors are removed. A cleaning apparatus is attached to the printer or press, and developing units and tubes are cleaned. A new ink color supply is installed, and building and calibration processes are performed on the newly installed ink color.

An additional cost typically results when the specialty color is removed, and replaced with a further specialty color or a standard color. Once again, the printing press must be stopped, and cleaning and color building operations performed. Thus, time during which the printing press is non-operational contributes to the costs of operation.

SUMMARY OF THE INVENTION

A method, at least partially implemented by means of processor-executable instructions, for exchanging colors within a color station of a printing press is disclosed. In one implementation of the method, a cleaning tank is operated within the color station, thereby cleaning the color station. Additionally, a new color of ink is built within the cleaned color station.

This Summary is provided to introduce a selection of concepts in a simplified form that are further described below in the Detailed Description. This Summary is not intended to identify key features or essential features of the claimed subject matter, nor is it intended for use as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical items.

DETAILED DESCRIPTION OF THE PREFERRED EMBODIMENT

Figure 1:
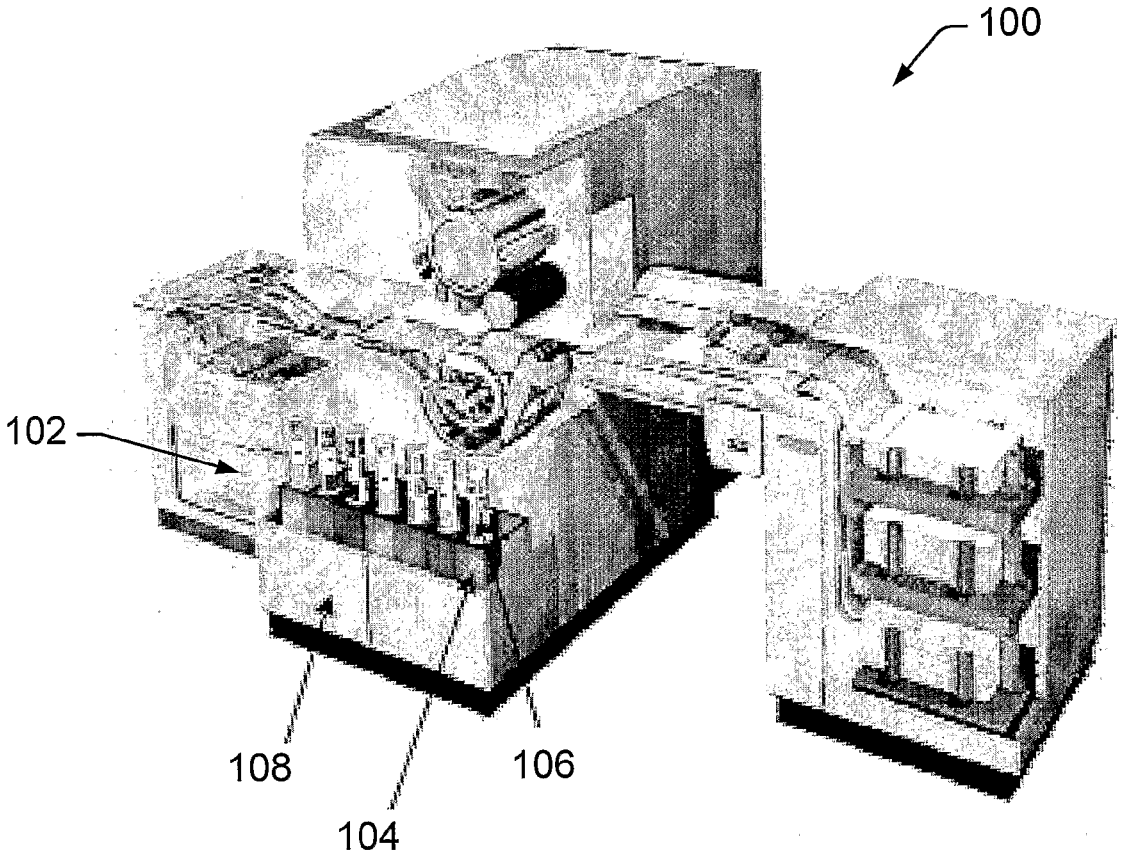
FIG. 1 illustrates one example of a printing press adapted according to the description disclosed herein.

The following discussion is directed to systems and methods that implement a cleaning system for use with a printing press. FIG. 1 illustrates one example of a printing press 100 adapted according to the description disclosed herein. The cleaning system includes a cleaning tank, adapted for insertion into a color station within the printing press 100. The cleaning system also includes a control procedure resident within the printing press 100 and discussed more fully in FIGS. 3A and 3B. In operation, the control procedure controls the operation of a cleaning process including operation of the cleaning tank, and controls the operation of a building process wherein a new color is configured after the cleaning process is completed. In a typical implementation, the control procedure prints jobs by operating color stations not being cleaned while the cleaning and new color building processes in progress.

Continuing to refer to FIG. 1, the example printing press 100 includes seven color stations 102; however, the press 100 could be configured with a greater or lesser number of color stations, as required by any particular implementation. In the example of FIG. 1, each color station 102, includes both fixed and removable components. The fixed components include tubes and a developing unit (discussed with respect to FIG. 2), which are cleaned without removal from the printing press 100. The removable components include an ink tank 104 and an ink can 106. In an alternate embodiment, these removable components may be combined. In a still further embodiment, each color station 102 may include other removable components that, when exchanged, replenish an exhausted ink supply.

The ink tank 104 and ink can 106 are configured for manual insertion into, and removal from, a 'receiver' or 'socket' 108. The receiver 108 interfaces with the ink tank 104 and ink can 106, thereby allowing the press 100 to control the operation of the ink tank and ink can. In particular, the press 100 controls the application of ink from the ink tank 104 and ink can 106 onto a developing unit, and from there onto print media.

Figure 2:
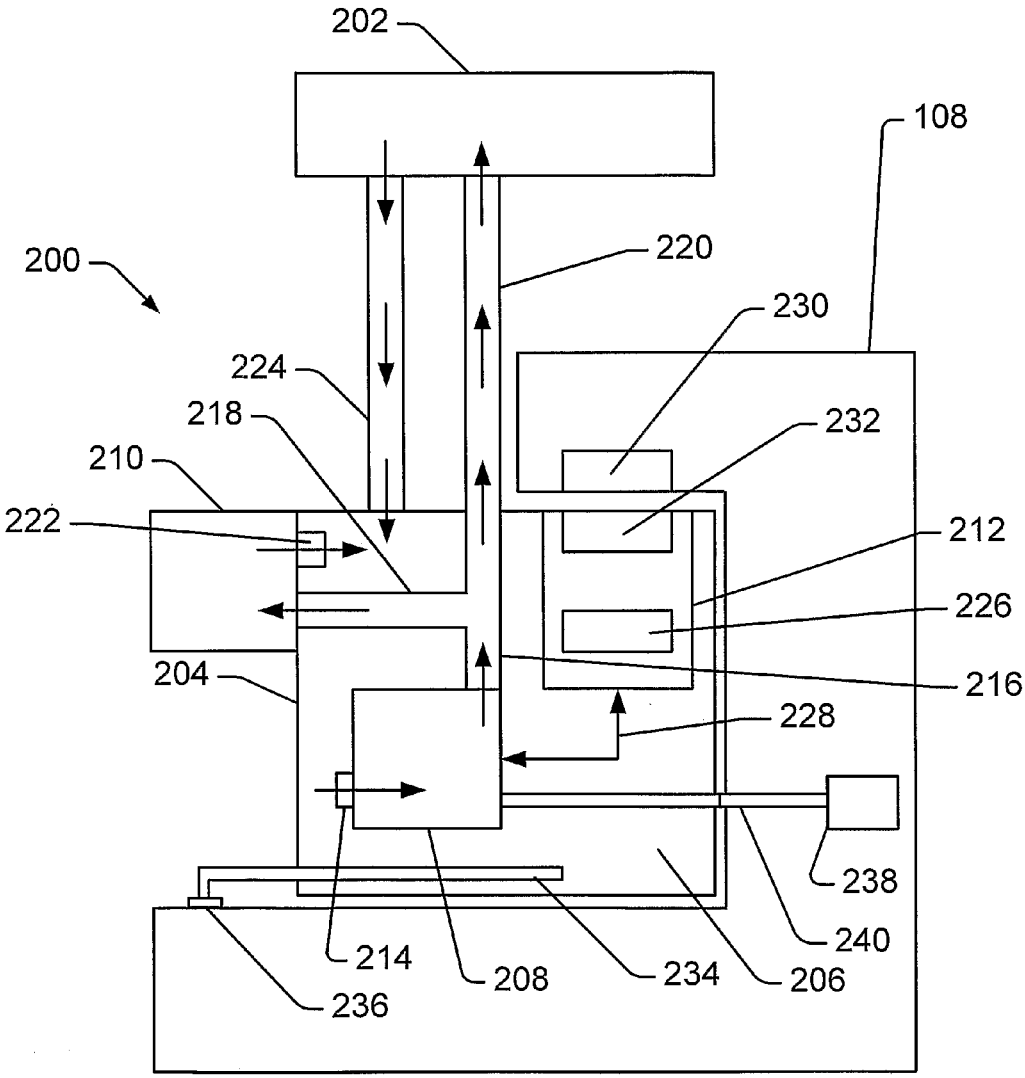
FIG. 2 illustrates a block diagram showing an example of a cleaning tank interfaced to a printing press.

FIG. 2 illustrates a block diagram showing an example of a cleaning tank 200 interfaced to the receiver 108 of a color station 102 (FIG. 1) of a printing press 100 (FIG. 1). In operation, the cleaning tank 200 provides cleaning fluid to the developing unit 202, wherein the developing unit is a portion of the color station 102 (FIG. 1) that is typically fixed in an internal location within the printing press 100. More particularly, the printing press 100 (FIG. 1) provides instructions to the cleaning tank 200, resulting in circulation of cleaning fluid to the developing unit 202, tubes, pipes and other structures within a color station 102 (FIG. 1). In a preferred implementation, the press 100 or cleaning tank 200 heats and/or controls the temperature of the cleaning fluid to maximize cleaning process efficiency. During the cleaning process, wherein instructions are provided to operate the cleaning tank 200, additional instructions to other color stations result in the continued work on print jobs.

In the example of FIG. 2, the cleaning tank 200 includes a fluid reservoir 204 containing cleaning fluid 206, a pump 208 to circulate the cleaning fluid, a filter 210 to remove ink and/or impurities from the cleaning fluid, and a circuit card 212 to interface with the printing press 100 (FIG. 1) and to thereby allow the press to control operation of the cleaning tank 200.

The reservoir 204 is typically configured according to a form factor that allows it to fit into the receiver 108 after removal of the ink tank 104 and ink can 106 (FIG. 1). Accordingly, an operator can manually remove the ink tank 104 and ink can 106 of a color station 102 (all seem in FIG. 1). Once removed, the user can manually insert the cleaning tank 200 within the color station 102. In a preferred embodiment, the reservoir 204 contains sufficient cleaning fluid 206 to clean the one color station without replacement of the cleaning tank 200. In one example, the cleaning fluid used is known as "imaging oil"; however, it is anticipated that any known cleaning fluid could be used, as desired.

Continuing to refer to FIG. 2, the pump 208 includes an intake port 214, which receives cleaning fluid 206 from within the reservoir 204. The pump 208 releases the cleaning fluid under some pressure through supply line 216. In the example of FIG. 2, the supply line 216 delivers cleaning fluid 206 to a filter intake port 218 and a developing unit input line 220. Following removal of ink and/or other debris from cleaning fluid passing through the filter 210, filtered cleaning fluid is returned to the fluid reservoir 204 via an exhaust port 222.

Cleaning fluid passing through the developing unit input line 220 cleans ink and/or debris from the developing unit 202 before returning to the reservoir 204 via a return line 224.

As seen above, the circuit card 212 interfaces with the printing press 100 (FIG. 1). Accordingly, a control procedure—typically configured as software—is able to control operation of the cleaning tank 200. In particular, the control procedure within the printing press controls operation of the pump 208. Ina typical implementation, the control procedure operates the pump at a speed, and for a period of time, that is consistent with the task of cleaning the- developing unit 202 and other portions of the color station 102 (FIG. 1). In a typical implementation, the circuit card 212 also. controls the temperature of the cleaning fluid. A thermometer, typically in contact with the cleaning fluid 206, provides feedback to the circuit card 212. This information can be used to operate the heating (and/or cooling) tube 234.

Note that in one embodiment, the control procedure resident within the printing press 100 (FIG. 1) measures the time of operation of the operation of the cleaning tank 200 generally, and the pump 208 in particular. The pump 208 can be controlled by the circuit card 212, such as by operation of a signal or power line 228. In one implementation, a motor 238 and drive shaft 240 may also be controlled by the circuit card 212, and configured to operate the pump 208. The circuit card 212 can be controlled by a control procedure resident on the printing press 100, via electrical connections 230, 232. Note that connector 230 is configured to interface with the connector 232 of the circuit card 212, as well as the ink tank 106 and/or ink can 108 of the color station.

In an alternate embodiment, the control procedure resident within the printing press can receive input data from an optional densitometer 226 on the circuit card 212. The densitometer 226 is representative of any of a plurality of sensors adapted to examine cleaning fluid, and to track progress in the cleaning task. In operation, the densitometer 226 measures density of the cleaning fluid 206, and thereby determines if ink is still being removed from the developing unit 202. Thus, by obtaining data measurements made by the densitometer, the control procedure can gain information on the state of the cleaning process. For example, when the density of the cleaning fluid indicates that the cleaning fluid is 'clean,' i.e. free of ink and debris, then the control procedure can assume that the developing unit 202 and other portions of the color station 102 are clean. Thus, the cleaning process may be controlled by either timed operation of the pump 208, by reference to a sensor such as the densitometer 226, or by a combination of both. Additionally, the densitometer 226 can detect problems in the cleaning procedure. For example, failure of the density of the cleaning fluid to decrease may indicate that there is a problem in the filter.

In a further preferred embodiment, a heating/cooling tube 234 inside the reservoir 204 controls the temperature of the fluid 206. The tube 234 can be connected to the receiver 108 using a quick connection 236. The heating/cooling tube 234 provides control over the temperature of the cleaning fluid, which increases the efficiency of the cleaning process. Accordingly, the cleaning fluid may be maintained at a desired temperature while circulating within the color station.

Note that in one embodiment illustrated by FIG. 2, the pump 208 pumps the cleaning fluid in two 'parallel circuits,' wherein a first portion of the cleaning fluid is pumped through the developing unit 202 of a color station 102 and a second portion of the cleaning fluid is pumped through the filter 210. In an alternative embodiment, the filter 210 could be 'in series' with the developing unit; i.e. fluid could leave the pump 208, pass through the filter 210, then pass through the developing unit 102, before returning to the fluid reservoir 204. However, in many applications this configuration is less satisfactory, since the pressure drop across the filter is difficult to predict with precision. An alternative configuration, wherein the cleaning fluid leaving the pump passes through the developing unit first, and then passes through the filter, is also less satisfactory in many applications, since fluid leaving the developing unit is typically gravity-fed back to the reservoir 204, and has insufficient pressure to pass through the filter.

Exemplary Methods

Figure 3A:
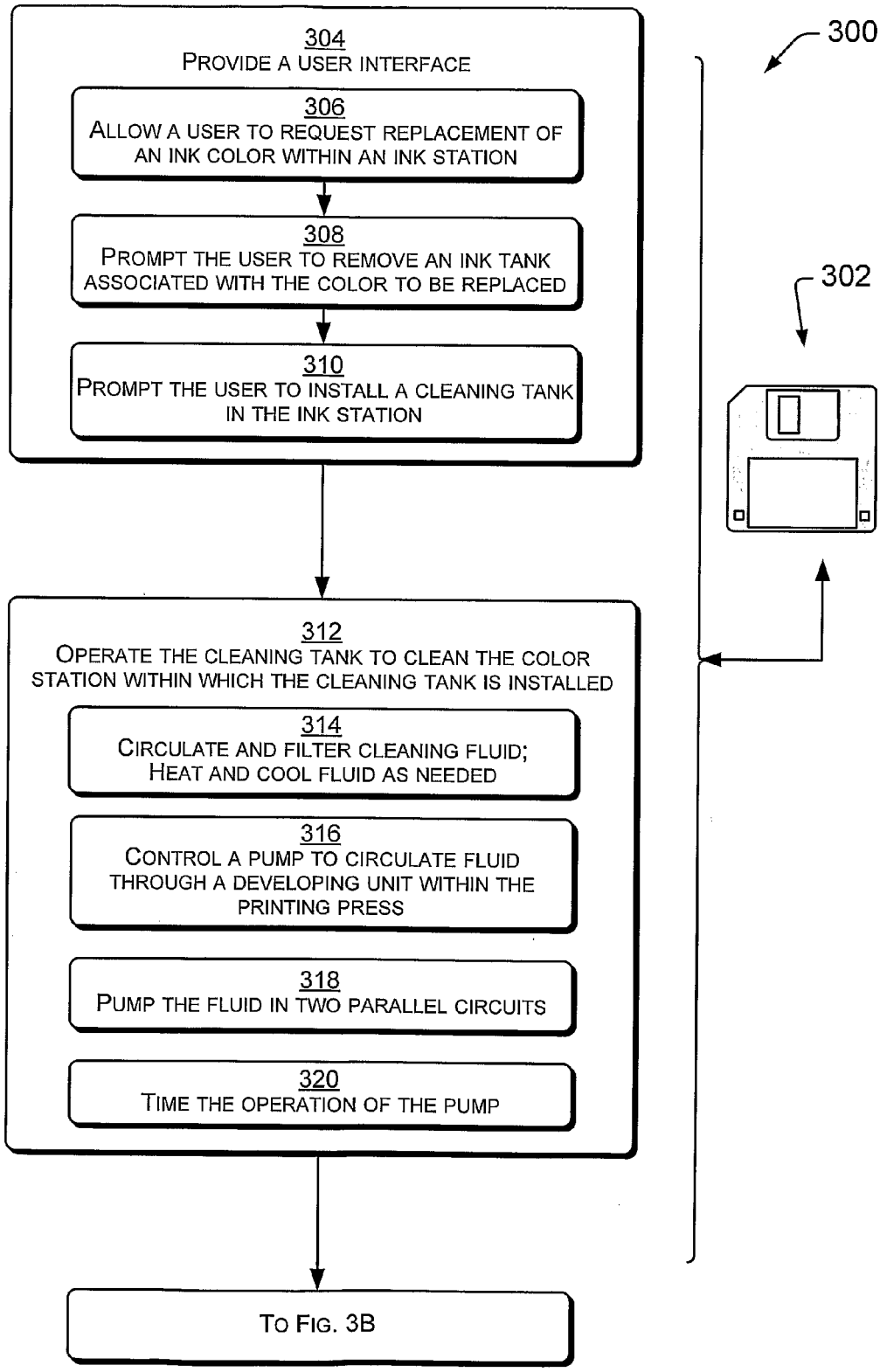
FIGS. 3A and 3B illustrate an example by which a printing press cleaning system can be operated.
Figure 3B:
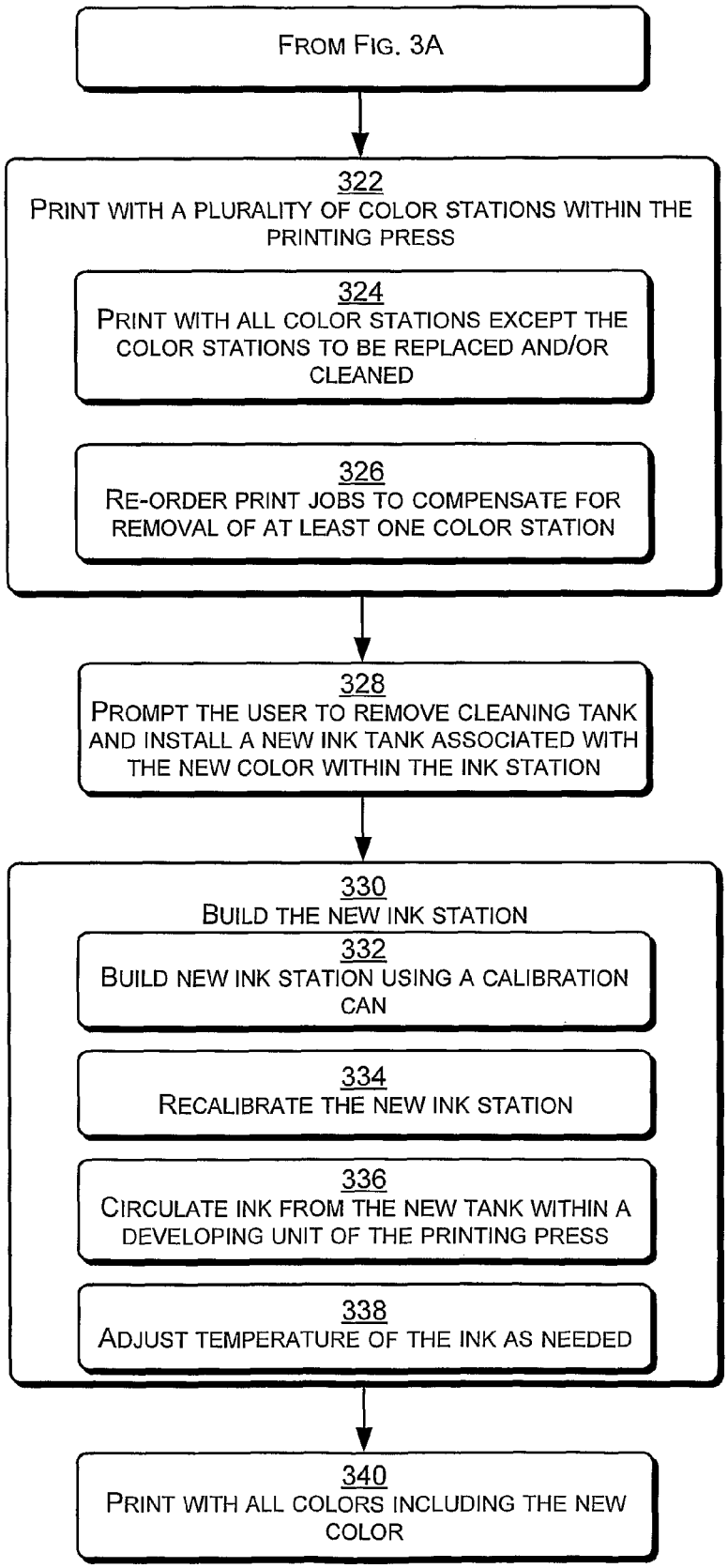

FIGS. 3A and 3B disclose an example method 300 by which a printing press cleaning system can be implemented and operated, and by which a color replacement may be performed. For purposes of better illustrating the discussion, the method will be associated with the printing press 100, as seen in FIG. 1 and the cleaning tank 200, as seen in FIG. 2. The engineer trained in printing press design will realize that the teachings of the discussions herein could be adapted for alternative implementations, as desired.

Accordingly, an example software control procedure 302, configured for operation by the printing press 100 (FIG. 1), implements aspects of a printing press cleaning system. That control procedure 302 will now be described with primary reference to the flow diagrams of FIGS. 3A and 3B, and secondary reference to the example structures of FIGS. 1 and 2. The methods 300 apply to a wide variety or printing presses generally and in particular to the operation of exemplary components discussed above with respect to FIGS. 1 and 2. While in one embodiment the control procedure 302 is configured as software, the elements of the described methods may be performed by any appropriate means including, for example, software, including execution of processor-readable instructions defined on a processor-readable medium, or hardware, including logic blocks on an ASIC or other electronic device.

As used herein, a computer and/or processor-readable medium can be any means that can contain or store instructions for use by or execution by a processor. A processor-readable medium can be, without limitation, an electronic, magnetic, optical, electromagnetic, infrared, or semiconductor system, apparatus, device, or propagation medium. More specific examples of a processor-readable medium include, among others, a portable computer diskette, a random access memory (RAM), a read-only memory (ROM), an erasable programmable-read-only memory (EPROM or Flash memory), a rewritable compact disc (CD-RW), and a portable compact disc read-only memory (CDROM).

At block 304, a user interface is provided by the printing press 100 (FIG. 1), allowing the user to issue commands to the control procedure and/or printing press, and to be prompted by the control procedure to perform tasks which must be performed Manually. Blocks 306-310 illustrate possible examples of operation of the user interface. At block 306, the user interface allows a user to request replacement of a color within a color station of the printing press: The user may indicate the color station wherein the replacement is to take place, the ink color to be removed (i.e. the currently installed ink color) and the ink color to be installed. At block 308, the user interface instructs (i.e. "prompts") the user to remove the ink tank 104 and the ink can 106 associated with the original color from the indicated color station. Accordingly, the user must manually remove the ink tank 104 and ink can 106 from the color station 102. As noted above, the ink tank and ink can may be integrated into a single component, or further divided according to the design utilized by the printing press. At block 310, the user interface prompts the user to install the cleaning tank 200 into the color station 102 of the printing press 100 wherein the color replacement is being performed. As seen in the discussion of FIG. 2, the form factor of the cleaning tank 200 is similar enough to the ink tank 104 and ink can 106 that the cleaning tank can be inserted into the color station 102.

At block 312, the cleaning tank is operated, thereby cleaning the color station within which the cleaning tank is installed. Blocks 314-320 illustrate possible examples of operation of cleaning tank. At block 314, cleaning fluid is circulated and filtered. The cleaning fluid may be heated and/or cooled as needed, such as by heating/cooling rod 234 (FIG. 2). More particularly, at block 316, operation of a pump is controlled, wherein the pump actively circulates cleaning fluid through a developing unit and associated tube, pipes, valves, etc., within the printing press. Referring to the diagram of FIG. 2, passage of cleaning fluid through the developing unit 202 cleans ink and debris from the unit, as well as pipes 220 and 224. In the example of block 318, the fluid is pumped in two parallel circuits. Referring particularly to FIG. 2, it can be seen that the pump circulates cleaning fluid through the developing unit 202 and the filter 210 in a 'parallel' manner, rather than in 'series'. Thus, the pump 208 circulates cleaning fluid through the filter 210, which removes ink and debris from the cleaning fluid. The pump also circulates fluid through the developing unit 202, thereby cleaning the color station 102: At block 320, the operation of the pump 208 can be controlled by the control procedure 302 by reference to a timer or clock. In an alternative embodiment, the control procedure 302 may reference a densitometer 226, or similar sensing device, to determine the state of the cleaning fluid. For example, if the device reports that the fluid is generally clean, then the developing unit 202 and/or other parts of the color station 102 can be considered clean.

At block 322, a plurality of color stations are used in the printing process. That is, while the cleaning steps of blocks 312-320 are in operation, and while the new ink station building blocks 330-338 are in operation, other color stations may be simultaneously involved in actively performing print jobs. Blocks 324 and 326 refine and/or clarify the process by which cleaning and printing are simultaneously performed. At block 324, all colors stations are used except the color station(s) being cleaned and/or replaced by a newly built ink station. That is, the control procedure 302 operating the printing press 100 is configured to operate and print using the printing press without the color station undergoing cleaning. At block 326, the control procedure 302 may be configured to reorder print jobs so that print job(s) printed during cleaning may be performed without the color station being cleaned. For example, a print queue having print jobs will be reordered to move print jobs not requiring the color removed at block 308 to earlier positions in the print queue, and to move print jobs requiring a new color to be built at blocks 330-338 to later positions in the print queue.

At block 328, the user is prompted to remove the cleaning tank and to install a new ink tank (and ink can, depending on the configuration of the printing press) associated with the new color within the ink station. The prompting is typically made to the user by means of a user ,interface of any type. The removal—the installation are typically performed manually by the user.

At block 330, the new ink station is built. While building can vary from printing press to printing press, blocks 332-336 provide example detail on the building process. In an implementation seen at block 332, the new ink tank 104 contains imaging oil and a calibration can or container that contains a specific amount of ink. Accordingly, ink fluid of a known density will be introduced into the press 100 after the can containing the specific amount of ink is emptied into the ink tank by the press. At block 334, the new ink tank is recalibrated. At block 336, ink from the new ink tank and/or can is circulated into the developing unit 202 (FIG. 2) of the printing press 100 (FIG. 1). At block 338, if needed, the temperature of the ink is adjusted.

At block 340, the printing press 100 resumes printing with all color stations, including the newly cleaned and newly built color station.

While one or more methods have been disclosed by means of flow diagrams and text associated with the blocks of the flow diagrams, it is to be understood that the blocks do not necessarily have to be performed in the order in which they were presented, and that an alternative order may result in similar advantages. Furthermore, the methods and/or method steps are not exclusive and can be performed alone or in combination with one another. For example, blocks 312, 322, 328 and 330 may be simultaneously active. In particular, the process of cleaning and/or the process of building a new color (i.e. configuring the replacement color) may be performed while printing with other colors.

Conclusion

Although aspects of this disclosure include language specifically describing structural and/or methodological features of preferred embodiments, it is to be understood that the appended claims are not limited to the specific features or acts described. Rather, the specific features and acts are disclosed only as exemplary implementations, and are representative of more general concepts.

The invention claimed is:

1. A cleaning system for a printing press having a plurality of color stations, the cleaning system comprising:

a cleaning tank including a filter, a fluid reservoir to contain a cleaning fluid, and a pump having an input communicated with the fluid reservoir and outputs directed to a developing unit within the printing press and the filter, the cleaning tank configured for installation within one of the color stations after removal of an ink tank from the one of the color stations; and a control unit configured for performing a control procedure, wherein the control procedure is configured for simultaneously:

printing with a plurality of color stations within the printing press; and operating the pump of the cleaning tank to clean the color station within which the cleaning tank is installed.

2. The cleaning system of claim 1, wherein the color station within which the cleaning tank is installed is configured with an electrical interface for the ink tank and an interface for the cleaning tank.

3. The cleaning system of claim 1, wherein the control unit is further configured for performing:

receiving a request from a user to replace a color associated with one of the color stations;

prompting the user to replace, with the cleaning tank, an ink tank associated with the color to be replaced;

wherein printing with the plurality of color stations within the printing press comprises printing with all colors except the color to be replaced;

wherein operating the pump of the cleaning tank to clean the color station comprises circulating cleaning fluid and filtering the cleaning fluid;

prompting the user to insert a new ink tank associated with a new ink color within the one of the color stations;

calibrating the new ink color in the new ink tank; and printing with all colors including the new ink color.

4. The cleaning system of claim 1, wherein the control unit is further configured for performing:

printing with all colors except a color in the ink tank replaced with the cleaning tank.

5. The cleaning system of claim 1, wherein the control unit is further configured for operating the pump of the cleaning tank to circulate the cleaning fluid through the developing unit within the printing press; and controlling temperature of the circulated cleaning fluid.

6. A cleaning system for a printing press having a plurality of color stations, the cleaning system comprising:

a cleaning tank including a filter, a fluid reservoir to contain a cleaning fluid, and a pump to direct the cleaning fluid from the fluid reservoir to both a developing unit within the printing press and the filter, the cleaning tank replacing an ink tank of one of the color stations; and a control unit to operate the cleaning tank to clean the one of the color stations of the printing press with the cleaning fluid and print with remaining color stations of the printing press during operation of the cleaning tank.

7. The cleaning system of claim 6, wherein each of the color stations include an electrical connector to interface with an ink tank and a cleaning tank.

8. The cleaning system of claim 6, wherein the control unit is further to:

receive a request from a user to replace a color associated with a color station;

prompt the user to replace, with the cleaning tank, an ink tank associated with the color to be replaced; and during operation of the cleaning tank, print with colors except the color to be replaced.

9. The cleaning system of claim 6, wherein the control unit is further to:

prompt a user to insert a new ink tank associated with a new color within a color station;

calibrate the new ink color in the new ink tank; and during calibration of the new ink color, print with other colors.

10. The cleaning system of claim 6, wherein the control unit is further to:

circulate the cleaning fluid through the developing unit of the printing press; and control temperature of the circulated cleaning fluid.

* * * * *